US005081497A

United States Patent [19]

Agarwal et al.

[11] Patent Number: 5,081,497

[45] Date of Patent: Jan. 14, 1992

[54] DOCUMENT REGISTRATION UTILIZING RETRACTABLE TRANSPARENT MEMBER BENEATH PLATEN

[75] Inventors: Vinod K. Agarwal; John A. Durbin, both of Webster; James J. Appel, Rochester, all of N.Y.

[73] Assignee: Xerox Corporation, Stamford, Conn.

[21] Appl. No.: 654,692

[22] Filed: Feb. 13, 1991

[51] Int. Cl.[5] ..... G03G 21/00

[52] U.S. Cl. ..... 355/230; 355/75; 355/311

[58] Field of Search ..... 355/230, 75, 311, 218, 355/219, 317, 71

[56] References Cited

U.S. PATENT DOCUMENTS

| | | | |
|---|---|---|---|
| 4,415,261 | 11/1983 | Yukawa et al. | 355/75 |
| 4,436,402 | 3/1984 | Seimiya et al. | 355/317 |
| 4,595,285 | 6/1986 | Miwa et al. | 355/75 |
| 4,600,293 | 7/1986 | Watanabe | 355/317 X |
| 4,721,981 | 1/1988 | Rauen et al. | 355/75 |
| 4,783,679 | 11/1988 | Anzai | 355/230 |

FOREIGN PATENT DOCUMENTS

| | | | |
|---|---|---|---|
| 57-150863 | 9/1982 | Japan | 355/219 |

*Primary Examiner*—A. T. Grimley
*Assistant Examiner*—Shuk Y. Lee

[57] ABSTRACT

A document registration guide as provided by mounting a retractable pattern bearing substrate beneath a glass document platen. The substrate operates in the manner of a window shade, presenting a plurality of document outlines which are visible to an operator during a pre-copy state. The operator can select the appropriate document outline pattern, and position the document to be exposed along the outline ensuring the required and proper registration for that document. At start of scan, the substrate is retracted out of the document exposure area and is returned to its initial position at the end of the copying cycle.

6 Claims, 2 Drawing Sheets

DOCUMENT REGISTRATION UTILIZING RETRACTABLE TRANSPARENT MEMBER BENEATH PLATEN

BACKGROUND AND MATERIAL DISCLOSURE STATEMENT

The present invention is directed towards registering a document to be copied on the glass platen of a copier, and more particularly, to present a set of visible document outlines as an aid to precise document registration.

An original document to be copied in an electrophotographic copying machine is typically placed on the glass platen of the machine in a position which registers the document at the proper location to effect the required imaging at the photoreceptor followed by subsequent transfer to the output copy medium. Registration systems are referred to as edge registered (document is registered along the left or right edge registration guide) or corner edge registered (document is registered along the edge and along a top or bottom corner of the registration guide). The edge and corner registration guides typical of the prior art are located adjacent to the glass platen and have a slightly raised surface so that the document can be aligned against the edge. There is a presistent problem present with casual operation of the machine in quickly determining the exact registration position for a document with differing size or differing orientation (long-edge or short-edge feed). While indicia may be present along the registration edge to assist in proper location selection, yet it may be confusing to the casual operator and produce operation and subsequent unwanted copies until the proper location is finally found. From a human factor point of view it would be desirable to have outlines of documents of various sizes visible to an operator at the platen surface and prior to operation so that the operator could simply match the document to be copied with an outline position and place the document within the identified outline borders. In order to provide this type of feature, however, a fundamental technical requirement must be met; that is, the set of patterns seen by the operator must be invisible during the subsequent imaging or copy operation, else the outline would effect the output copy adversely. This requirement rules out proposed solutions such as etching the patterns into the glass of the platen, since the etched portions would be in the optical path of the document image and would create unwanted diffusion and reflection of light.

According to a first aspect of the present invention, a set of patterns are visible to an operator prior to start of the copy operation and are then moved out of the exposure path upon initiation of a copying cycle. This is accomplished in a first embodiment by locating a retractable "window shade" film substrate beneath the platen, the substrate having the document sizes formed, in outline, within the substrate. The operator can easily find the outline pattern to match the document to be copied and place the document thereon. Upon initiation of the copying mode, the substrate is retracted and is no longer visible to the operator, nor to the optical system. According to a second aspect of the invention, a platen cleaning member is attached to the substrate to provide an additional function as the substrate moves to the retracted position.

More particularly, the present invention relates to an electrophotographic copying machine provided with a glass platen for placing documents to be copied thereon and includes a document registration guide assembly comprising, a flexible substrate positioned beneath said platen, underlying the document exposure area, said substrate having formed therein visible outlines of a plurality of document sizes, each document size pattern corresponding to a correctly registered document position on the overlying platen surface, and means for positioning said substrate beneath said platen so that said outlines are visible during a non-copying mode, and means adapted to move the substrate out of the exposure area when a copy mode cycle is initiated.

A search of the prior art has identified a number of patents disclosing various document positioning mechanisms, none of which discloses the above-described concept of the present invention. Representative of the prior art are the following patents:

U.S. Pat. No. 4,595,285 to Miwa et al. discloses an electrophotographic copying machine comprising a translucent document cover with paper size index lines for providing accurate document positioning on a document table during a manual copying process. The translucent cover 3 pivotally rotates in and out of position over a glass plate. The cover includes paper size index lines 7 for indicating a copy size outline for various size papers to provide accurate document positioning on a glass plate 2. (See col. 2, lines 29–37 and FIG. 1.) Cover 3 also includes marks 70–79 for indicating various image size ratios for magnifying or reducing the copy document. (See col. 3, lines 28–50 and FIG. 5.)

U.S. Pat. No. 4,436,402 to Seimiya et al. discloses a copy board comprising index plate position indexes 3*a*, 4*a*, 4*b*, 5*b* of various sizes which are used to correlate document positioning with the optics of a copying machine. (See col. 3, lines 48–54 and FIG. 2.)

U.S. Pat. No. 4,415,261 to Yukawa et al. discloses a copying machine comprising a platen cover which includes color marks or patterns for properly positioning an original on a transparent plate. (See col. 4, lines 1–9).

U.S. Pat. No. 4,783,679 to Anzai discloses an original-setting table 2 for properly aligning document of different sizes with the optics of a copying machine.

U.S. Pat. No. 4,721,981 to Rauen et al. discloses a copying machine comprising a retractable "curtain shade" platen cover 24, i.e., a thin flexible film, that reels out from a scroll 26 into position over and above a document platen 14 during a copying process. See col. 9, lines 5–16 and 44–56 and FIG. 1.

DESCRIPTION OF THE INVENTION

Figure 1:
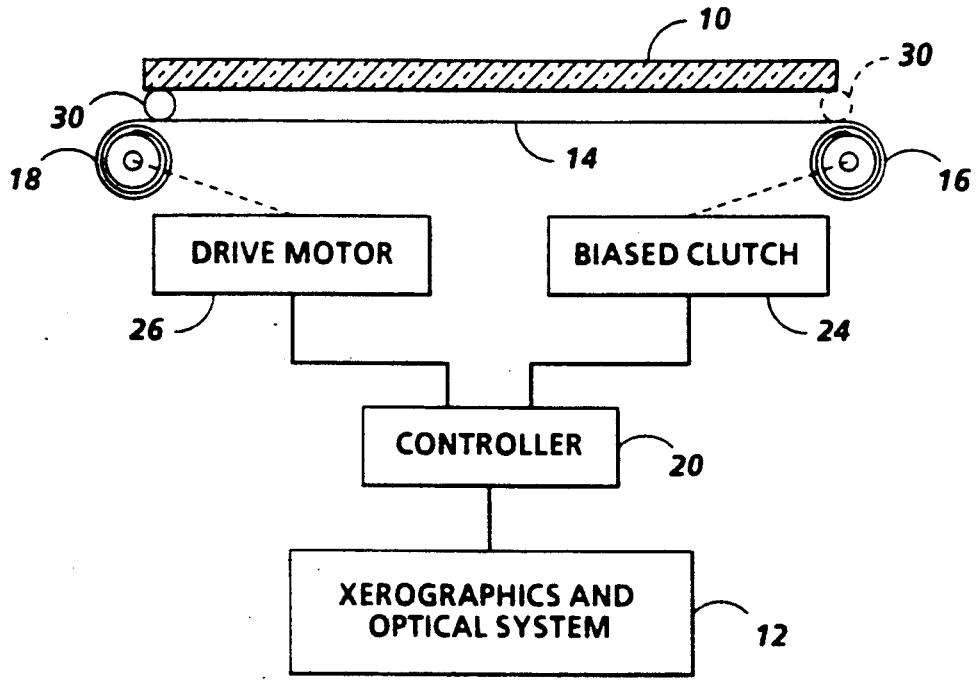
FIG. 1 is a side view of a document platen in a copier showing the location of the retractable substrate of the present invention.
Figure 2:
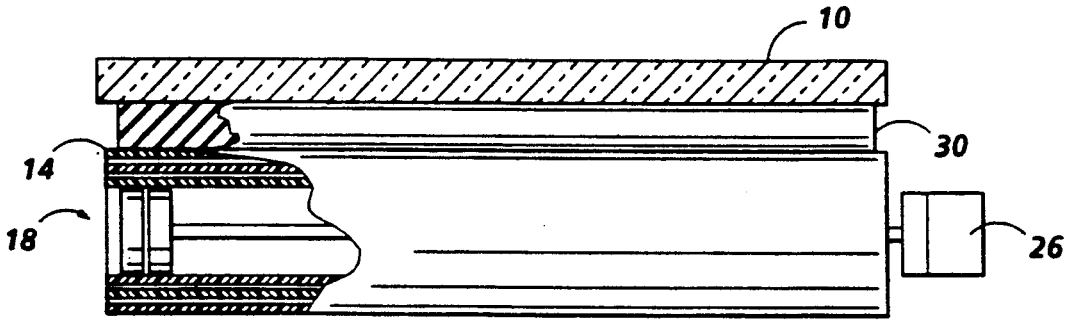
FIG. 2 is an end view of the platen and substrate shown in FIG. 1.
Figure 3:
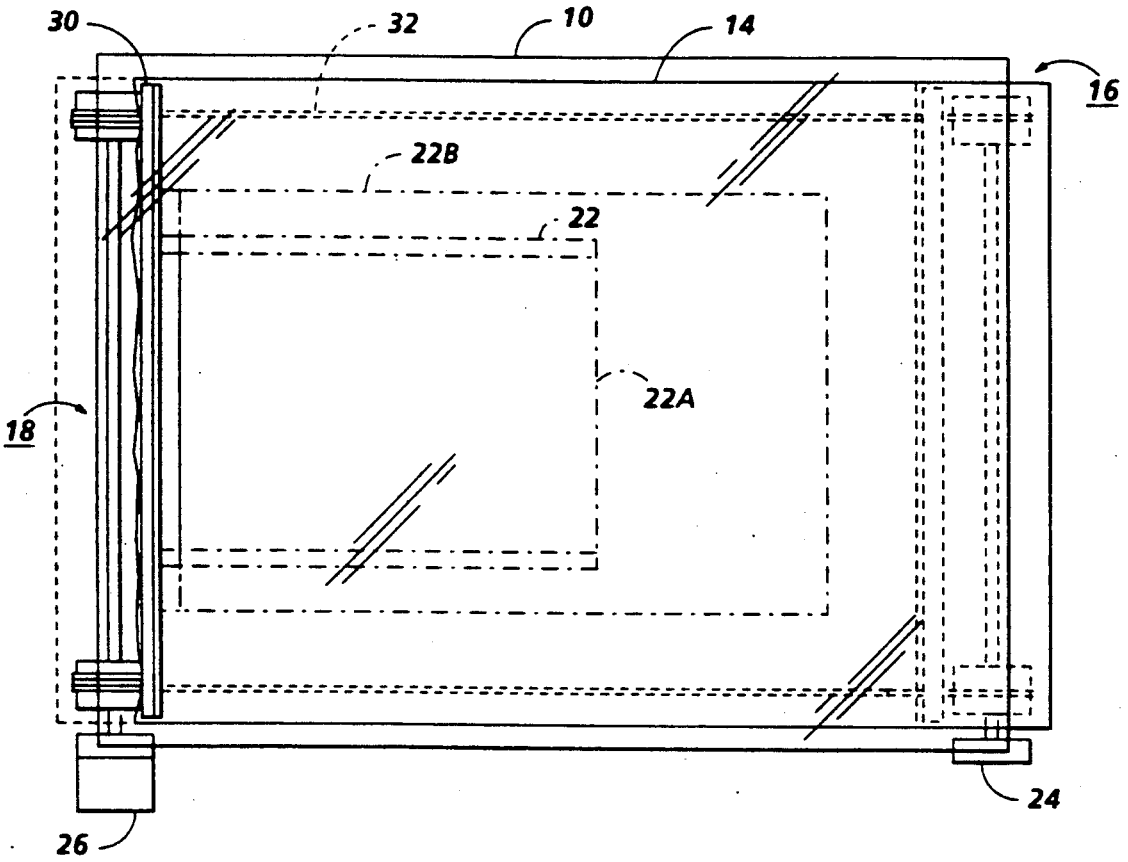
FIG. 3 is a top view of the platen and substrate show in FIGS. 1 and 2.

Referring now to FIGS. 1–3, there is shown a glass platen 10 upon which are placed documents to be reproduced by an optical system located in the optical cavity beneath the underlying platen 10. Also underlying platen 10 in a parallel horizontal plane is a flexible substrate 14 entrained between a first roller pair assembly 16 and a second, roller pair assembly 18, driven by signals from system controller 20. Roller assembly 16 is biased in the manner of a window shade to urge substrate 14 to be wrapped up around its core in the absence of a opposite force. Substrate 14 in the preferred embodiment is a transparent, polyester film having predetermined reflective transmissive and translucent characteristics which result in various document size patterns 22, 22A, 22B (FIG. 3) to be visible to an operator. Substrate 14, in the position shown in FIG. 3, presents to an operator a number of document size patterns which can be matched to the document desired to be printed. Upon identification of the proper size pattern, and placing of the document thereon, the operator will initiate a copy mode by depressing a start button. This action is detected in a Xerographics and optical system 12 and a signal sent to controller 20. Controller 20 controls the operation of a clutch 24 de-energizing the clutch allowing the pattern-bearing portion of substrate 14 to be retracted on a biased roller assembly 16. The substrate ends are connected by light-weight cables 32 on the inboard and outboard sides and are not visible to the system optics.

Upon the end of the copying mode a signal is sent to clutch 24 actuating the clutch and drive motor 26 causing the biasing roller member 16 to withdraw the substrate from roller assembly 16 and returns that portion of the substrate 14 bearing the patterns to the visible portion (exposure area) of the platen.

According to a second aspect of the present invention, a soft, nonabrasive cleaning member 30 is attached to the top of substrate 14 and extends the width of the substrate. In a preferred embodiment, member 30 is a soft brush in contact with the underside of the platen. Upon start of the scanning cycle, and with retraction of substrate 14, member 30 is moved to the right and provides a cleaning operation to the underside of the platen. The cleaning operation is repeated as the substrate is returned to the exposure area. Alternatively, member 30 may be a foam element.

According to a still further aspect of the present invention, the patterns 22, 22A, and 22B can be formed by embedding a plurality of light emitting diodes (LEDs), and wire interconnections into strategic locations in the substrate lines. The LEDs would be positioned with their emitting side facing up so as to be visible to an operator. The system controller is then connected to the LED energization circuit which will cause the LEDs to be selectively turned on forming the visible document size patterns. This embodiment is especially useful to permit an operator to position the original on the platen in long edge or short edge feed orientation in response to magnification (reduction or enlargement) selection.

In a still further embodiment, depending upon the space provisions of the optical cavity, the substrate, instead of being moved laterally between roller assemblies, may be physically moved down the side of the optical cavity using, for example, a track formed on the inside vertical wall of the cavity.

While the embodiment disclosed herein is preferred, it will be appreciated from this teaching that various alternative, modifications, variations or improvements therein may be made by those skilled in the art, which are intended to be encompassed by the following claims:

What is claimed is:

1. In an electrophotographic copying machine provided with a glass platen for placing documents to be copied thereon, a document registration guide assembly comprising a flexible substrate positioned beneath said platen and underlying a document exposure area, said substrate being a flexible transparent member having formed therein visible outlines coresponding to a plurality of document sizes, said visible outlines formed by selection of transparent opaque and translucent segments of the member so as to form the particular outlines, each document outline corresponding to a correctly registered document position on the overlying platen surface, and a controller means for positioning said substrate beneath said platen so that said outlines are visible prior to copying, said controller means adapted to move the substrate out of the exposure area when a copy mode cycle is initiated and to return the substrate to the exposure area when the copy mode is completed.

2. The mechanism of claim 1 wherein said outlines are formed by light emitting diodes and further including control means to selectively activate said diodes so as to form images of the desired document outlines.

3. The machine of claim 1 wherein said means includes a first roller assembly which is biased so as to tend to roll up said substrate thereon and further including a second roller assembly which is rotated in response to signals from said controller means, said controller means generating a voltage signal to said second assembly upon initiation of a copy cycle.

4. The machine of claim 1 wherein said means includes means for moving said substrate perpendicular to the process direction and down the side of the machine in response to a start copy mode.

5. The machine of claim 1 further including a cleaning member attached to the top of said substrate and extending the width of said substrate, the cleaning member being in non-abrasive contact with the bottom of the platen and providing a cleaning aperture during the movement of said substrate.

6. A method for registering documents of different dimensions on a document platen comprising of the steps of:

placing the document on said platen, registering the document with one of a plurality of document outlines formed on a flexible transparent substrate positioned beneath said platen, and initiating a copy mode while simultaneously removing said transparent substrate from its position beneath said platen.

* * * * *